United States Patent [19]

Jakobeit

[11] Patent Number: 5,007,865

[45] Date of Patent: Apr. 16, 1991

[54] ELECTRICAL RECEPTACLE TERMINAL

[75] Inventor: Erich D. Jakobeit, Ruesselsheim, Fed. Rep. of Germany

[73] Assignee: AMP Incorporated, Harrisburg, Pa.

[21] Appl. No.: 498,874

[22] Filed: Mar. 26, 1990

[30] Foreign Application Priority Data

Sep. 28, 1987 [DE] Fed. Rep. of Germany ... 8713038[U]

[51] Int. Cl.[5] ..... H01R 4/48

[52] U.S. Cl. ..... 439/839; 439/856

[58] Field of Search ..... 439/389, 391, 396, 397, 439/816, 839, 871, 876, 851-857

[56] References Cited

U.S. PATENT DOCUMENTS 4,583,812 4/1986 Gross et al. ..... 339/259 R

FOREIGN PATENT DOCUMENTS 3540869 5/1987 Fed. Rep. of Germany .

87092516 4/1987 PCT Int'l Appl. .

OTHER PUBLICATIONS

European Search Report.

*Primary Examiner*—David Pirlot

*Assistant Examiner*—J. R. Daulton

*Attorney, Agent, or Firm*—Bruce J. Wolstoncroft

[57] ABSTRACT

The terminal comprises a receptacle portion (2) having a channel shaped body (8) provided with contact spring (14), and a backing spring support (6) secured to the body (8) and having a pair of backing springs (24) engaging the contact springs (14). The backing spring support (6), which is also channel shaped, is secured about the body (8) by means of two pairs of flanges (34) which are peened over to engage the free longitudinal edges (38) of the body (8). Longitudinal movement of the backing spring support (6) relative to the body (8) is prevented by lugs (40) provided on the longitudinal edges (38) of the body (8) and which project between the flanges (34) of the pairs of flanges (34 ).

5 Claims, 1 Drawing Sheet

ELECTRICAL RECEPTACLE TERMINAL

FIELD OF THE INVENTION

This invention relates to a stamped and formed electrical receptacle terminal, especially such a terminal for receiving a male contact element in the form of a tab.

BACKGROUND OF THE INVENTION

A known stamped and formed electrical receptacle terminal comprises a receptacle portion, a wire connecting portion, and a backing spring portion, the receptacle portion comprising a channel shaped body having a base and a pair of side walls upstanding from opposite edges of the base, and a pair of cantilever contact springs projecting in juxtaposed relationship, each from a respective sidewall at one end of the body, each contact spring having a bowed contact surface proximate to its free end, the contact surfaces being bowed towards one another to receive a male contact element between them, the wire connecting portion extending from the other end of the body, the backing spring portion comprising a backing spring support secured to the body and from which project a pair of cantilever backing springs resiliently restraining movement of the contact springs away from each other, each backing spring having a free end portion projecting substantially normally thereof and having a free end engaging the respective contact spring at a position opposite to its contact surface.

SUMMARY OF THE INVENTION

It is an object of the invention to provide such a receptacle terminal, having a backing spring portion which can easily be assembled to, and securely fixed to, the body of the receptacle portion.

According to the invention, the backing spring support is channel shaped and receives the body of the receptacle portion, said support having a base engaging the base of the body, and side walls, each of which is substantially parallel to a side wall of the body, a pair of flanges projecting from the free longitudinal edge of each side wall of the backing spring support, being spaced from each other longitudinally of said free edge and engaging over the free longitudinal edge of a respective side wall of the body, a lug upstanding from such edge between said flanges.

The backing spring portion can easily be assembled to the receptacle portion, with the said flanges in an upright position, the flanges being thereafter peened over so as to engage over the free longitudinal edges of the side walls of the body. The lugs, which project between the peened over flanges, serve to restrain longitudinal relative movement between the backing spring support and the body, whereas the peened over flanges serve to prevent relative lateral movement therebetween.

The wire connecting portion may comprise an elongate base plate projecting rectilinearly from the base of said body, a wire connecting device comprising a pair of side walls upstanding from opposite edges of said base plate and having inwardly directed end portions defining wire receiving slots, one at each end of said wire connecting device, the wire connecting portion also comprising, on the side of said wire connecting device remote from said receptacle portion a pair of ears upstanding from opposite edges of said elongate base plate, in offset relationship longitudinally thereof.

An insulated wire can be inserted by means of a suitable tool, into both of said wire slots so that the edges thereof pierce the insulation of the wire to make firm electrical contact with the electrically conductive core thereof, and the ears can be curled over about the insulation of the wire to provide strain relief between the electrical connections between the core of the wire and the edges of the wire receiving slots. Alternatively, the wire connecting portion may be in the form of a conventional crimping ferrule.

Where the terminal is to be mounted in a cavity in an insulating housing, a locking tongue is provided, which projects from the base of the body of the receptacle portion at said one end thereof, obliquely away therefrom and between the side walls of said body and has a free end at the other end of the body proximate to, but lying above the free longitudinal edges of the side walls of the body.

When the terminal is inserted into the cavity, the free end of the locking tongue serves to engage a shoulder in the cavity to restrain withdrawal of the terminal therefrom.

BRIEF DESCRIPTION OF THE DRAWINGS

For a better understanding of the invention and to show how it may be carried into effect, reference will be made by way of example, to the accompanying drawings in which.

DETAILED DESCRIPTION OF THE INVENTION

Figures 1, 2, 3, 4:
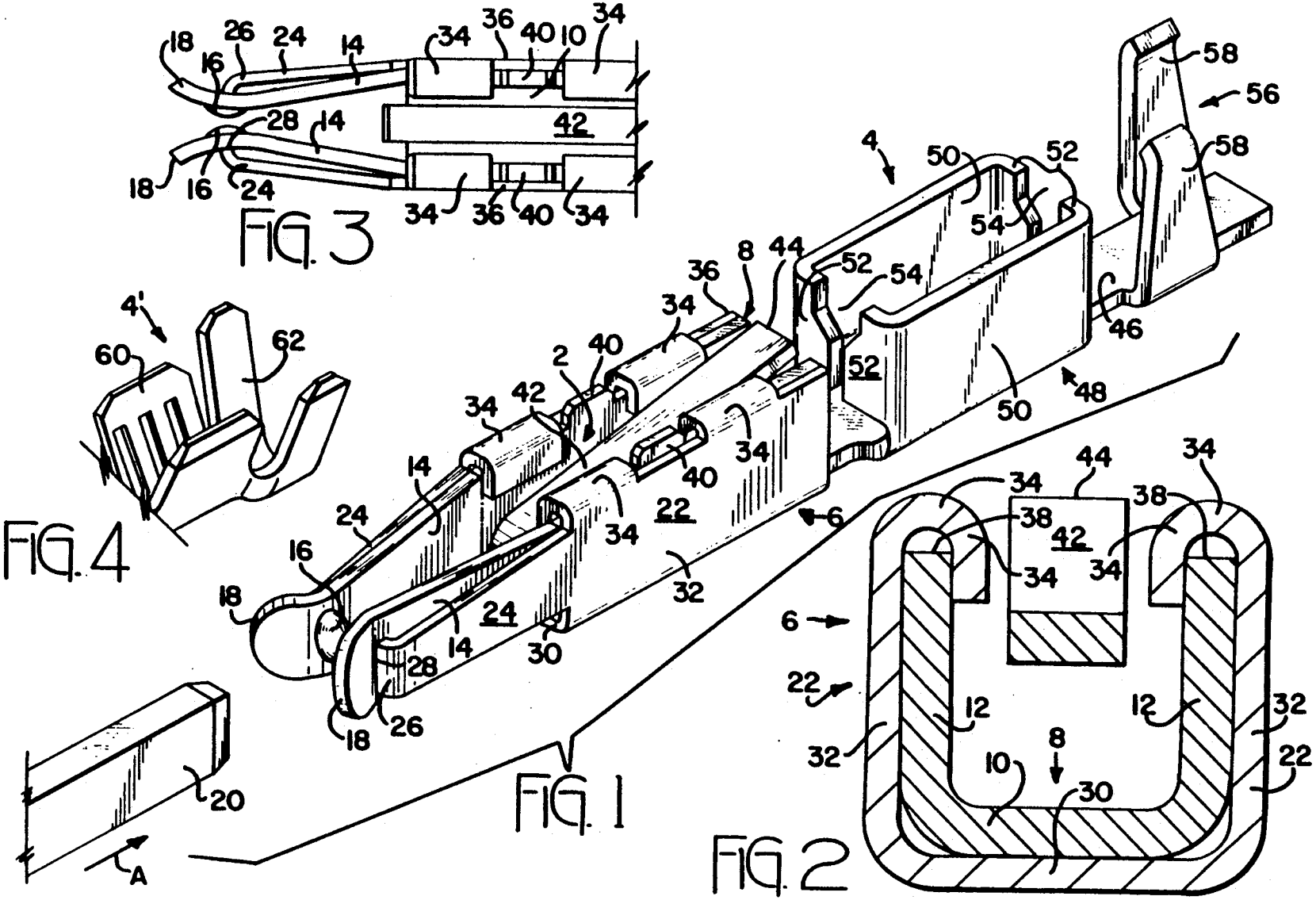
FIG. 1 is an isometric view of an electrical receptacle terminal having a wire connecting portion.
FIG. 2 is an enlarged cross-sectional view or the terminal.
FIG. 3 is a fragmentary plan view of the terminal.
FIG. 4 is an isometric view of an alternative form of wire connecting portion for the terminal.

The terminal which has been stamped and formed from sheet metal stock, comprises a receptacle portion 2, a wire connecting portion 4, and a backing spring portion 6.

The receptacle portion 2, comprises a channel shaped body 8 having a planar base 10 and a pair of planar side walls 12 upstanding from opposite edges of the base 10. A pair of cantilever contact springs 14 project in juxtaposed relationship, each from an end of a respective side wall 12 at the forward end of the body 8. Each contact spring !4 has a bowed contact surface 16 proximate to its free end 18, said contact surfaces 16 being bowed towards each other to receive a male contact element 20 in the form of a flat tab, between them, in the direction of the arrow A in FIG. 1. The wire connecting portion 4 extends from the rear end of the body 8. The backing spring portion 6, comprises a backing spring support 22 secured to the body 8 and from which project a pair of cantilever backing springs 24 resiliently restraining movement of the contact springs 14 away from each other, as the male element 20 is inserted between the contact surfaces 16.

Each backing spring 14, has a free end portion 26 projecting substantially normally thereof and having a free end 28 engaging the respective contact spring 14 at a position opposite to its contact surface 16.

The backing spring support 22 is channel shaped, and receives the body 8 of the receptacle portion 2, the support 22 having a planar base 30 parallel to and contiguous with the base 10 of the body 2, and planar side walls 32 each of which is parallel to and contiguous with a side wall 12 of the body 2. Two flanges 34 project from the free longitudinal edge 36 of each side wall 32 of the backing spring support 22, the flanges 34 of each pair being spaced from each other longitudinally of said free edge 36 and engaging over the free edge 38 of a respective side wall 12 of the body 8, a lug 40 upstanding from the side wall 12, longitudinally centrally thereof between said flanges 34.

A cantilever locking tongue 42 projects from the forward end of the base 10, and extends obliquely away therefrom and between the side walls 12 of the body 8. The tongue 42 has a free end 44, proximate to, but lying above, the free longitudinal edges 38 of the side walls 12.

The wire connecting portion 4 comprises an elongate base plate 46, coplanar with the base 10 of the body 8, a wire connecting device 48 comprising a pair of side walls 50 upstanding from opposite edges of the base plate 46 and having inwardly directed end portions 52 defining a wire receiving slot 54 at each end of the wire connecting device 48. The portion 4 also comprises an insulation crimping ferrule 56 on the side of the wire connecting device 48 remote from the receptacle portion 8 and consisting of a pair of ears 58 upstanding from opposite edges of the base plate 46, in offset relationship longitudinally thereof.

In order to electrically connect the receptacle terminal to the electrically conductive central core of an insulated electrical lead (not shown), the lead is forced, by means of a suitable tool (not shown) into the wire slots 52 so that the edges thereof pierce the insulation of the wire and make electrically conductive contact with said core, the ears 58 being curled over about the insulation of the wire, to provide strain relief for the electrical connections between the core and the walls of the slots 52.

The terminal can be inserted into a terminal receiving cavity in an insulating housing (not shown) so that the free end 44 of the tongue 42 engages a shoulder in the cavity to restrain withdrawal of the terminal therefrom.

When assembling the terminal, the body 8 is inserted into the support 22, with the flanges 34 thereof in an upright position. The flanges 34 are then peened over the free edges 38 of the side walls 12 of the body 8 to secure the body 8 and the support 22 against relative lateral movement, the lugs 40 projecting between the flanges 34 serving to secure the body 8 and the support 22 against relative axial movement.

The localized engagement of the free ends 28 of the free end portions 26 of the backing springs 24, behind the contact surfaces 16 of the contact springs 14, ensures a suitably high contact force between the contact surfaces 16 and the male element 20. Since the backing springs 24 are stood off, back from their free end portions 26, from the contact springs 14, these stood off parts of the backing springs do not rub against the contact springs 14 when the tab 20 is inserted between the contact surfaces 16.

As an alternative to the wire connecting portion 4, the terminal may be provided with a conventional crimping ferrule 4' (FIG. 4) having a portion 60 for crimping about the bared electrically conductive core at a stripped end of an electrical lead and a portion 62 for crimping about the insulation of the lead.

What is claimed is:

1. A stamped and formed electrical terminal comprising a receptacle portion, a wire connecting portion and a backing spring portion, the receptacle portion comprising a channel shaped body having a base and a pair of side walls upstanding from opposite edges of the base, a pair of cantilever contact springs projecting in juxtaposed relationship, each from a respective side all at one end of the body, each contact spring having a bowed contact surface proximate to its free end, said contact surfaces being bowed towards each other to receive a male contact element between them the wire connecting portion extending from the other end of the body, the backing spring portion comprising a backing spring support secured to the body and from which project a pair of cantilever backing springs resiliently restraining movement of the contact springs away from each other, each backing spring having a free end portion projecting substantially normally thereof and having a free end engaging the respective contact spring at a position opposite to its contact surface; characterized in that the backing spring support is also channel shaped and receives the body of the receptacle portion, said support having a base superposed with the base of the body and side walls each of which is substantially parallel to a side wall of the body, a pair of flanges projecting from the free longitudinal edge of each side wall of the backing spring support and being spaced from each other longitudinally of said free longitudinal edge and engaging a free edge of a respective side wall of the body from which free edge upstands a lug between said flanges, a cantilever locking tongue projecting from the base of said body at said one end thereof, obliquely away therefrom and between the side walls of said body and having a free end at the other end of the body, proximate to, but lying above, the free longitudinal edge of said side walls of the body.

2. A terminal according to claim 1 characterized in that the wire connecting portion comprises an elongate base plate projecting resiliently from the base of the body, a wire connecting device comprising a pair of side walls upstanding from opposite edges of said base plate and having inwardly directed end portions defining a wire receiving slot one at each end of said connecting device remote from said receptacle portion a pair of ears upstanding from opposite edges of said elongate base plate, in offset relationship longitudinally thereof.

3. A stamped and formed electrical terminal comprising a receptacle portion, a wire connecting portion and a backing spring portion, the receptacle portion comprising a channel shaped body having a base and a pair of side walls upstanding from opposite edges of the base, a pair of cantilever contact springs projecting in juxtaposed relations from respective side walls, the backing spring portion has a backing spring support secured to the body and from which project a pair of cantilever backing springs resiliently restraining movement of the contact springs away from each other, a cantilever locking tongue projecting from the base of said body at said one end thereof, obliquely away therefrom and between the side walls of said body and having a free end at the other end of the body, proximate to, but lying above a free longitudinal edge of said side walls of the body.

4. A terminal according to claim 3 wherein the backing spring support is channel shaped and receives the body of the receptacle portion, said support having a base superposed with the base of the side walls each of which is substantially parallel to a side wall of the body, a pair of flanges projecting from the free longitudinal edge of each side wall of the backing spring support and being spaced from each other longitudinally of said longitudinal edge and engaging the free edge of a respective side wall of the body from which free edge upstands a lug between said flanges.

5. A terminal according to claim 4 wherein the wire connecting portion comprises an elongate base plate projecting rectilinearly from the base of the body, a wire connecting device comprising a pair of side walls upstanding from opposite edges of said base plate and having inwardly directed end portions defining a wire receiving slot one at each end of said connecting device, said connecting portion also comprising, on the side of said wire connecting device remote from said receptacle portion a pair of ears upstanding from opposite edges of said elongate base plate, in offset relationship longitudinally thereof.

* * * * *